US009640346B2

(12) United States Patent
Cai

(10) Patent No.: US 9,640,346 B2
(45) Date of Patent: May 2, 2017

(54) KEYBOARD

(71) Applicant: Dongguan Zen-Tech Electronic Technology Co., LTD., Dongguan, Guangdong Province (CN)

(72) Inventor: Lin Cai, Dongguan (CN)

(73) Assignee: DONGGUAN ZEN-TECH ELECTRONIC TECHNOLOGY CO., LTD., Dongguan, Guangdong Province (CN)

( * ) Notice: Subject to any disclaimer, the term of this patent is extended or adjusted under 35 U.S.C. 154(b) by 0 days.

(21) Appl. No.: 15/009,821

(22) Filed: Jan. 28, 2016

(65) Prior Publication Data

US 2017/0076882 A1 Mar. 16, 2017

(30) Foreign Application Priority Data

Sep. 11, 2015 (CN) ..... 2015 2 0704457 U
Jan. 22, 2016 (CN) ..... 2016 2 0065539 U

(51) Int. Cl.
*H01H 13/79* (2006.01)
*H01H 13/02* (2006.01)
*H01H 13/785* (2006.01)

(52) U.S. Cl.
CPC ..... *H01H 13/79* (2013.01); *H01H 13/023* (2013.01); *H01H 13/785* (2013.01); *H01H 2219/062* (2013.01)

(58) Field of Classification Search
CPC .... H01H 13/79; H01H 13/023; H01H 13/785; H01H 2219/062
USPC ..... 200/5 A, 5 R, 293–296, 303, 512–517
See application file for complete search history.

(56) References Cited

U.S. PATENT DOCUMENTS 5,001,307 A * 3/1991 Blaser ..... H01H 13/70 200/293
5,608,603 A * 3/1997 Su ..... G06F 3/0202 200/303
7,462,788 B2 * 12/2008 Miyauchi ..... H01H 23/30 200/5 R
2008/0173525 A1 * 7/2008 Yoshida ..... H01H 13/04 200/296

* cited by examiner

*Primary Examiner* — Edwin A. Leon
(74) *Attorney, Agent, or Firm* — Cheng-Ju Chiang

(57) ABSTRACT

The present invention provides a keyboard. The keyboard includes a circuit board, a key installing board, and a plurality of key switches, the circuit board is disposed opposite the key installing board, the key installing board is provided with a plurality of installation holes corresponding to the key switches, the plurality of key switches are movably clamped on the key installing board through the plurality of installation holes, each of the key switches has a conductor, the conductor extends in the direction of near the circuit board through an installation hole, the circuit board is provided with a plurality of connection terminals working with conductors of the plurality of key switches, the conductors of the plurality of key switches are contacted with the plurality of connected terminals of the circuit board. The key switches of the keyboard of the present invention are moveable, elongating use-life of the keyboard.

15 Claims, 12 Drawing Sheets

KEYBOARD

CROSS-REFERENCE TO RELATED APPLICATIONS

This application claims priority from Chinese Patent Application No. 201520704457.0 filed on Sep. 11, 2015, and Chinese Patent Application No. 201620065539.X filed on Jan. 22, 2016. The contents of the above-mentioned patent applications is hereby incorporated by reference herein in their entirety and made a part of this specification.

FIELD OF THE INVENTION

The present invention relates to the field of keyboard technology, and more particularly to a keyboard.

BACKGROUND OF THE INVENTION

The mechanical keyboards have huge influence in gamers, and it has advantage over normal membrane keyboard in reaction speed and touch sensor.

After the games rise and the competitive games became more popular, demand for the mechanical keyboards is pushed.

Each of keys of the traditional keyboard is an individual key switch. For a mechanical keyboard, many key switches are need to welds to a print circuit board, and then fixing the key switches according to iron plate, so it is difficult to repair when a key switch of the mechanical keyboard is damaged. In actually used, one key switch breaks down and the whole keyboard is damaged. Therefore, because the key switch of the actual keyboard cannot be moved, use-life of the keyboard is reduced.

SUMMARY OF THE INVENTION

Therefore, the present invention provides a keyboard, which can convenient move key switches, so as to elongating use-life of the keyboard.

The present invention uses following various embodiments to solve the technology problem.

The present invention provides a keyboard, the keyboard comprises a circuit board, a key installing board, and a plurality of key switches, the circuit board is disposed opposite the key installing board, the key installing board is provided with a plurality of installation holes corresponding to the key switches, the plurality of key switches are movably clamped on the key installing board through the plurality of installation holes, each of the key switches comprises a conductor, the conductor extends in the direction of near the circuit board through an installation hole, the circuit board is provided with a plurality of connection terminals working with conductors of the plurality of key switches, the conductors of the plurality of key switches are contacted with the plurality of connected terminals of the circuit board.

In one embodiment, each of the connected terminals comprises a flat spring, the flat spring comprises a junction and a first abutment disposed opposite the junction, the junction of the flat spring is disposed on the circuit board, the first abutment of the flat spring is contacted with a conductor of a key switch.

In one embodiment, each of the connected terminals further comprises a first side plate and a second side plate disposed opposite the first side, the junction of the flat spring is connected between the first side plate and the second side plate, the flat spring further comprises a second abutment disposed opposite the junction, the second abutment is disposed on one side of the first abutment, and space between the first abutment and the circuit board is greater than space between the second abutment and the circuit board, the first side plate is provided with a first convex block, the second side plate is provided with a second convex block, the first convex block and the second convex block are against on the second abutment.

In one embodiment, the plurality of connection terminals are columnar structures, and a first end of each of the connection terminals is connected to the circuit board, the second end of each of the connection terminals is contacted with a conductor of a key switch.

In one embodiment, contact surfaces between the plurality of connection terminals and the plurality of conductors are bump surfaces.

In one embodiment, the plurality of connection terminals are columnar structures, a first end of each of the connection terminals is connected to the circuit board, a second end of each of the connection terminals is provided with a position limitation hole, the conductors of the plurality of key switches are disposed in position limitation holes of the connection terminals.

In one embodiment, each of the key switches is provided with a light pipe, the circuit board is provided with a plurality of LED lights working with light pips, the light pip of each of the key switches above a LED light.

In one embodiment, the keyboard further comprises a pad plate, the pad plate is disposed between the key installing board and the circuit board, the pad plate is provided with a plurality of hollow holes working with the plurality of the installation holes, the circuit board is exposed from the plurality of hollow holes.

In one embodiment, the pad plate is made of plastic.

In one embodiment, the key installing board is connected to the circuit board through a plurality of bolts, and the plurality of bots support the key installing board.

In one embodiment, the conductors of the plurality of key switches are plated with gold.

In one embodiment, the circuit board 110*a* is further provided with a waterproof pouch, the plurality of connection terminals are disposed in a holding cavity of the waterproof pouch.

In one embodiment, the waterproof pouch comprises a sidewall and a top plate, a first end of the sidewall is connected to the circuit board, the second end of the sidewall is connected to the top plates of the water proof pouch.

In one embodiment, the key switch comprises a top lid, at least one first clearance hole is disposed on the top lid of the key switch, and the first clearance hole is connected to the key switch's chamber.

In one embodiment, the key switch comprises a bottom base, at least one second clearance hole is disposed on the bottom base of the key switch, and the second clearance hole is connected to the key switch's chamber.

The circuit board and the key installing board of the keyboard of the present invention are disposed in housing, and the circuit board is disposed opposite the key installing board, the plurality of key switches are movably clamped on the key installing board through the plurality of installation holes, the conductor extends in the direction of near the circuit board through the installation hole, and is contacted with the plurality of connected terminals of the circuit board, so when one key switch break down or malfunction, the key switch can be convenient moved and replace it with a new one, which can elongate use-life of the keyboard.

The above description is only an overview of the technical solutions of the present invention, and in order to more clearly understand technical means of the present invention and then can be implemented in accordance with contents of the specification, and in order to make the aforementioned and other objectives, features and advantages be more comprehensible, preferred embodiments will be described below in detail with reference to accompanying drawings.

DETAILED DESCRIPTION OF PREFERRED EMBODIMENTS

In order to further illustrate the technical means adopted for achieving the intended purpose of the present invention and effects thereof, specific implementations, methods, processes and effects of a keyboard and a LCD display device provided by the present invention will be described below in detail in preferred embodiments with reference to the accompanying drawings.

The foregoing and other related technical contents, features and effects of the present invention will be clearly described in detail below in the description of preferred embodiments with reference to accompanying drawings. By the illustration of specific embodiments, the technical means adopted for achieving the intended purpose and the effects thereof of the present invention can be comprehensively understood. However, the accompanying drawings are used for reference and description only, and not used to restrict the present invention.

Figure 1:
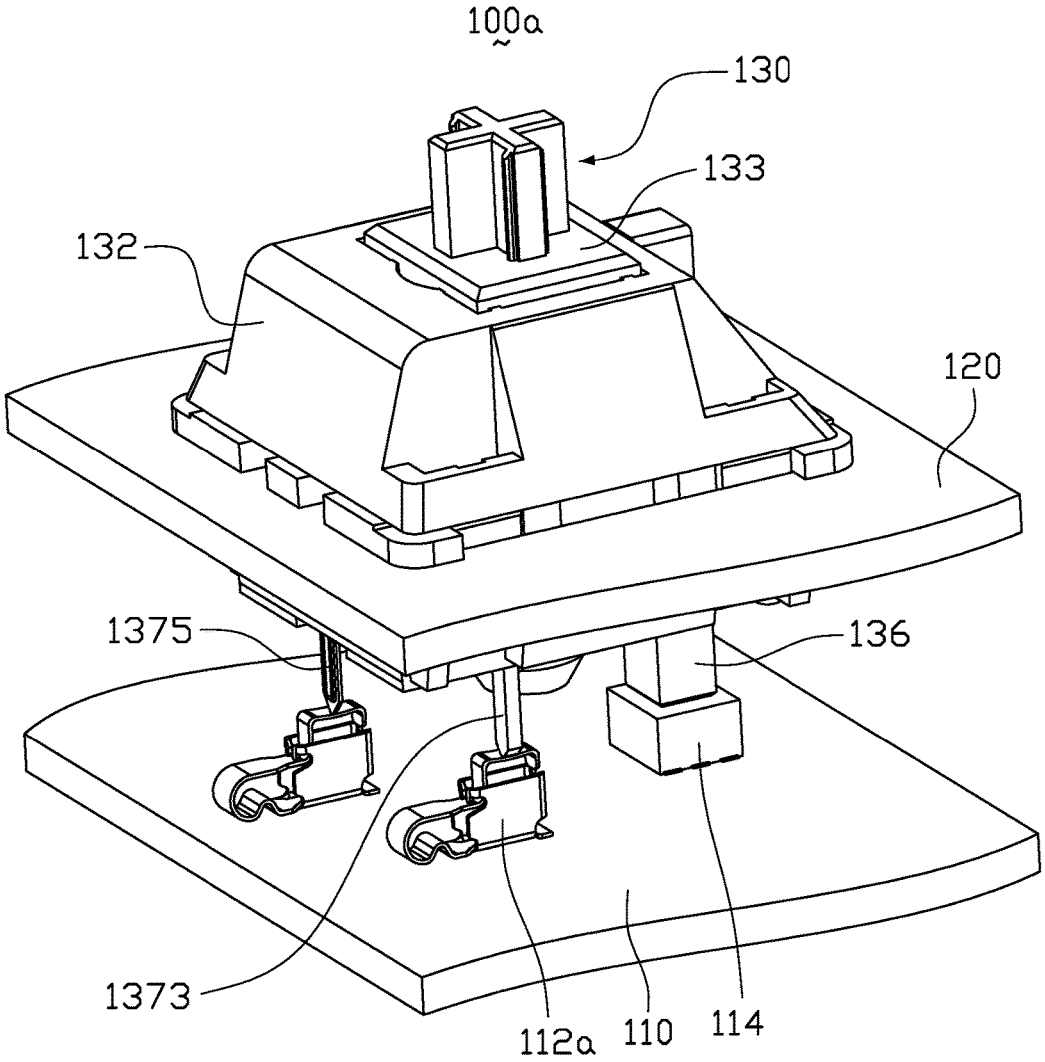
FIG. 1 is a partial structure view of a keyboard of a first embodiment of the present invention.
Figure 2:
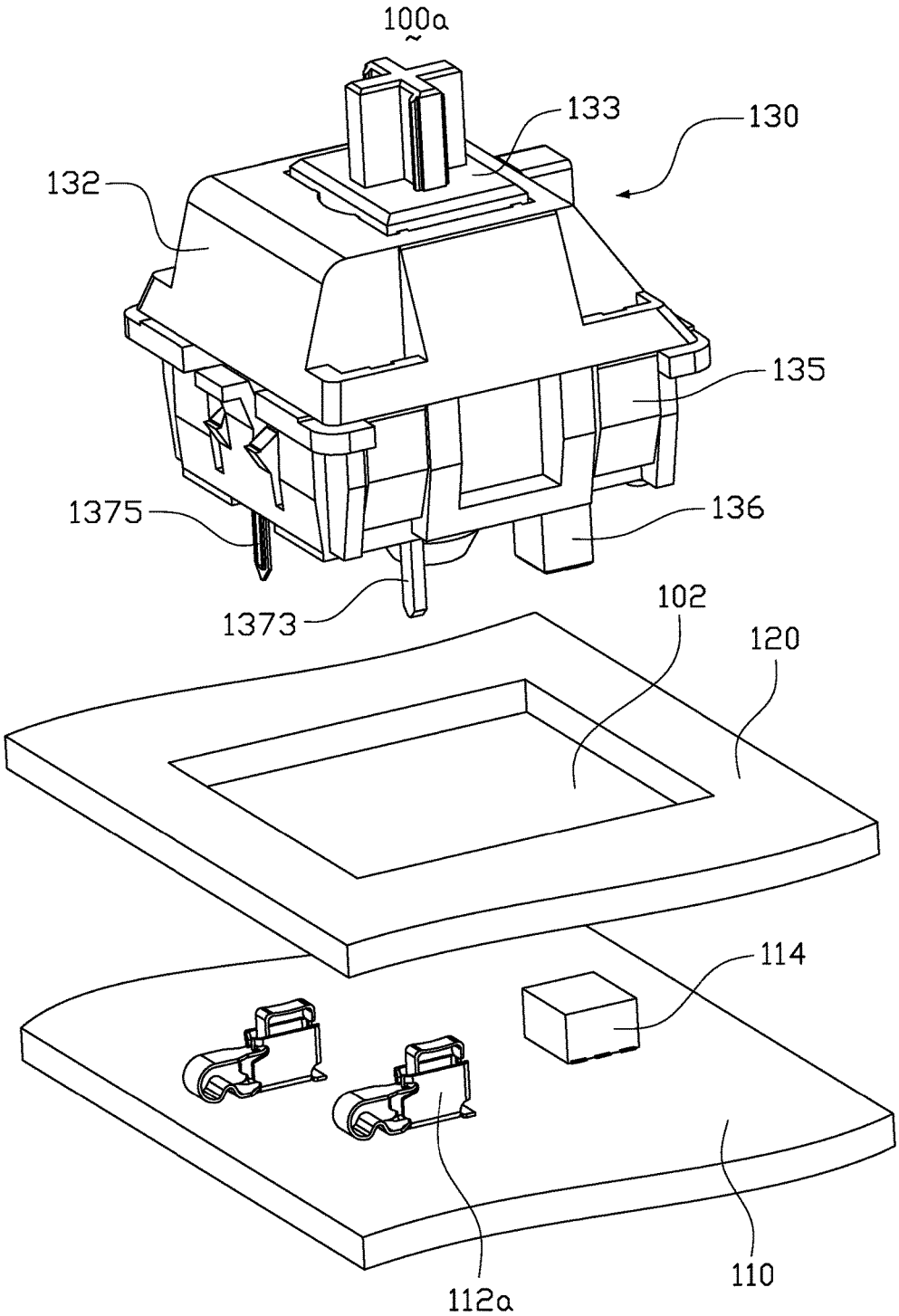
FIG. 2 is an exploded view of partial structure of the keyboard shown in FIG. 1.

FIG. 1 is a partial structure view of a keyboard of a first embodiment of the present invention. FIG. 2 is an exploded view of partial structure of the keyboard shown in FIG. 1. Please referring to FIG. 1 and FIG. 2, in the embodiment, a keyboard 100*a* includes a housing (not shown in figure), a circuit board 110, a pad plate (not shown in figure), a key installing board 120 and a plurality of key switch 130.

The circuit board 110, the pad plate and the plurality of key switch 130 are disposed in the housing, and the circuit board 110 is disposed opposite the key installing board 120, the pad plate is disposed between the circuit board 110 and the key installing board 120 to support the key installing board 120. The key installing board 120 is provided with a plurality of installation holes 102 corresponding to the plurality of the key switches 130. The pad plate is provided with a plurality of hollow holes working with the plurality of the installation holes 102, and the circuit board 110 is exposed from the plurality of hollow holes and the plurality of installation holes 102. The key switches 130 are movably clamped on the key installing board 120 through the installation holes 102. In the embodiment, the pad plate is made of plastic, but the present invention is not restricted to it. It's worth mentioning that there may be no the pad plate between the key installing board 120 and the circuit board 110 of the keyboard 100*a*, for example, the key installing board 120 also can connected to the circuit board 110 through a plurality of bolts, and the plurality of bolts support the key installing board 120.

Figure 3:
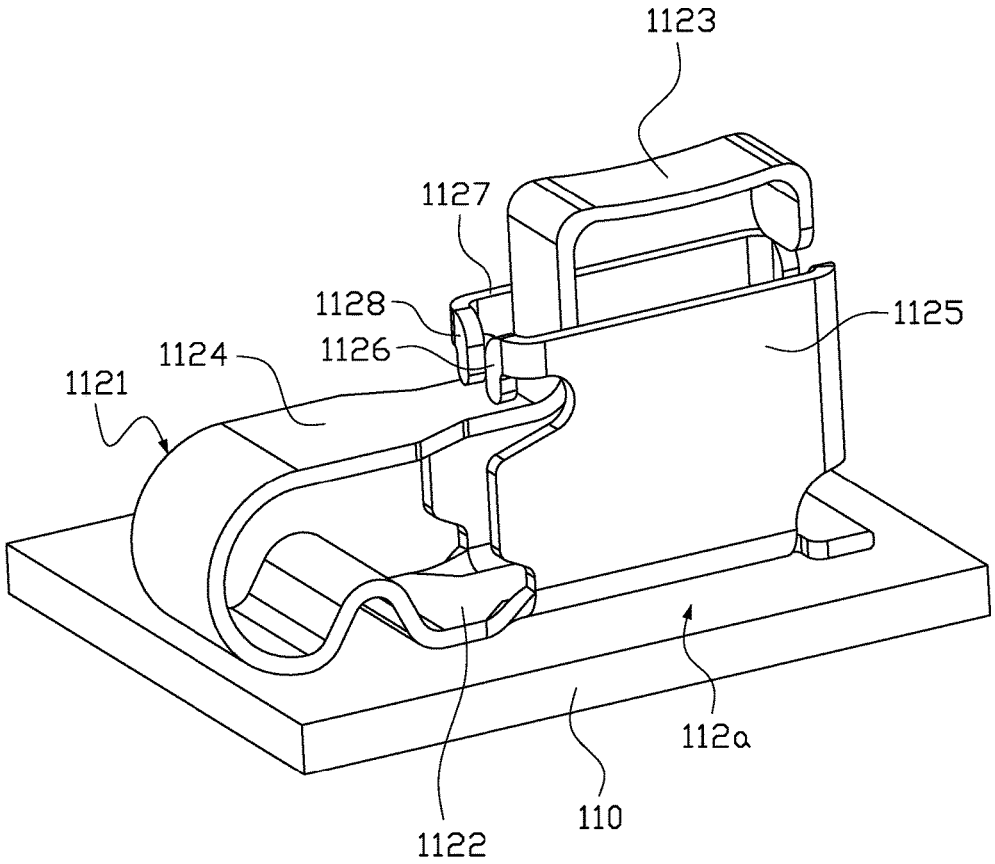
FIG. 3 is a magnification structure view of a connection terminal of the first embodiment of the present invention.

FIG. 3 is a magnification structure view of a connection terminal of the first embodiment of the present invention. Please referring to FIG. 1, FIG. 2 and FIG. 3, in the embodiment, the circuit board 110 is provided with a plurality of connection terminals 112*a* and a plurality of LED (light emitting diode) light 114. Each of the connection terminals 112*a* includes a flat spring 1121, a first side plate 1125 and a second side plate 1127. The flat spring 1121 includes a junction 1122, a first abutment 1123 and a second abutment 1124. The junction 1122 of the flat spring 1121 is disposed on the circuit board 110. The first abutment 1123 and the second abutment 1124 are disposed opposite the junction 1122. The second abutment 1124 is disposed on one side of the first abutment 1123, and space between the first abutment 1123 and the circuit board 110 is greater than space between the second abutment 1124 and the circuit board 110. An end of the first abutment 1123 extends in the direction of near the circuit board 110 to connect to the second abutment 1124. The second abutment 1124 extends in the direction away from the end of the first abutment 1123 to near the circuit board 110, and so as to connect to the junction 1122. The first side plate 1125 is disposed opposite the second side plate 1127. The junction 1122 of the flat spring 1121 is connected between the first side plate 1125 and the second side plate 1127. The first side plate 1125 is provided with a first convex block 1126 protruding in the direction of near the second side plate 1127, the second side plate 1127 is provided with a second convex block 1128 protruding in the direction of near the first side plate 1125, and the first convex block 1126 of the first side plate 1125 and the second convex block 1128 of the second side plate 1127 are against on the second abutment 1124. When the first abutment 1123 of the flat spring 1121 is pressed, deformation of the flat spring 1121 occurs, and the first abutment 1123 moves in the direction of near the circuit board 110 (the second abutment 1124 disconnects from the first convex block 1126 and the second convex block 1126 moves in the direction of near the circuit board 110); when the first abutment 1123 of the flat spring 1121 is not pressed, deformation of the flat spring 1121 disappears and the first abutment 1123 moves in the direction away from the circuit board 110 (the first convex block 1126 and the second convex block 1128 are against on the second abutment 1124).

Figure 4:
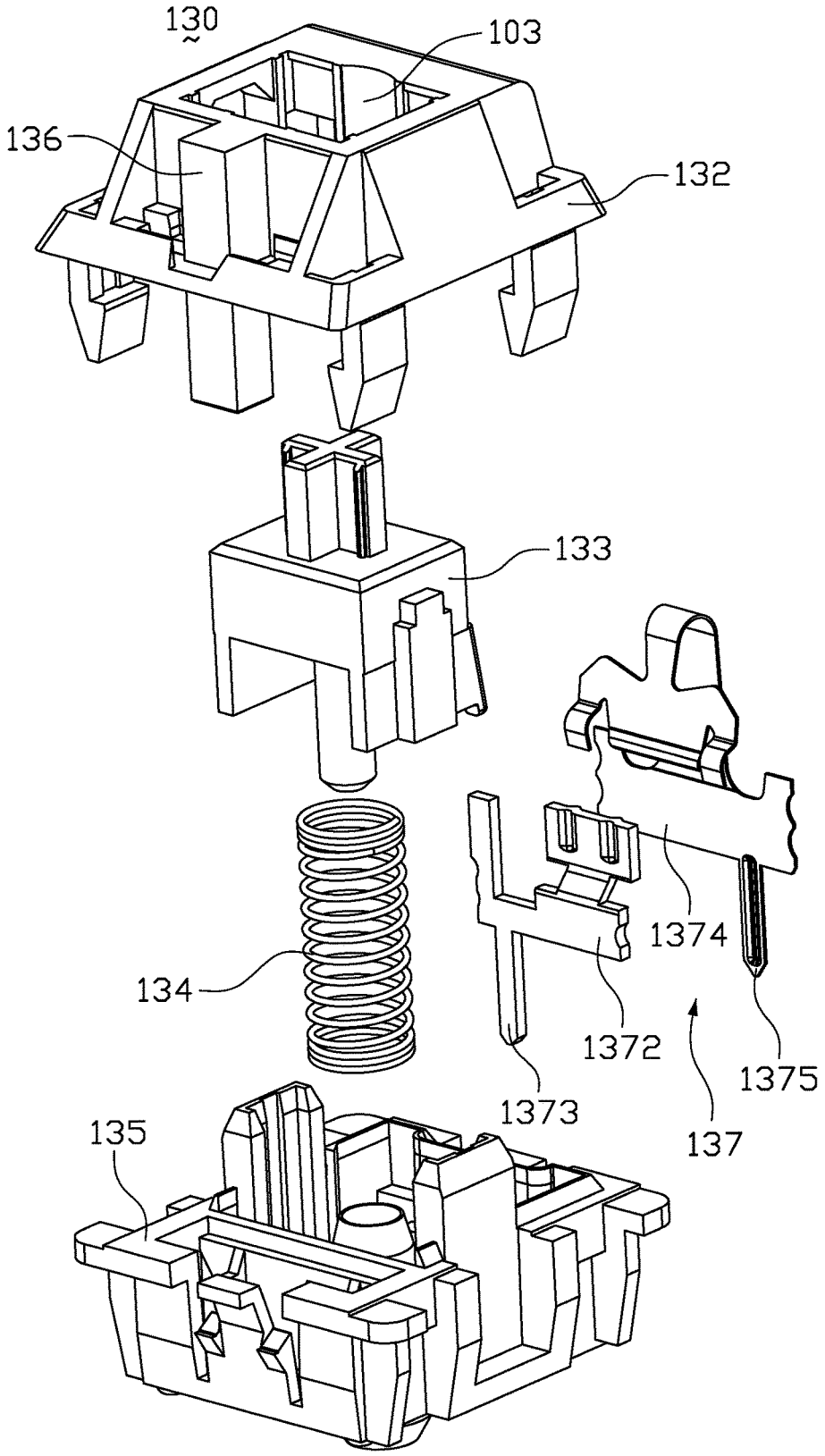
FIG. 4 is an exploded view of a key switch of the keyboard shown in FIG. 1.

FIG. 4 is an exploded view of a key switch of the keyboard shown in FIG. 1. Please referring to FIG. 1, FIG. 2, FIG. 3 and FIG. 4, in the embodiment, the key switch 130 includes a top lid 132, a press piece 133, a coil spring 134, a bottom base 135, a light pipe 136 and a conductor 137. The conductor 137 extends in the direction of near the circuit board 110 through the installation hole 102. The conductor 137 includes a fixed contact 1372 and a movable contact 1374, and the movable contact 1374 is disposed opposite the fixed contact 1372. The movable contact 135 is disposed on the bottom base 1374. The movable contact 1374 includes a conductive pin 1375. The conductive pin 1375 of movable contact 1374 passes through the bottom base 135 and is contacted with the first abutment 1123 of the connection terminal 112*a* of the circuit board 110. The fixed contact 1372 is disposed on the bottom base 1374. The fixed contact 1372 includes a conductive pin 1373. The conductive pin 1373 of the fixed contact 1372 passes through the bottom base 135 and is contacted with the first abutment 1123 of another connection terminal 112*a* of the circuit board 110. In one embodiment, the conducive pin 1373 of the fixed contact 1372 and the conductive pin 1375 of movable contact 1374 are plated with gold. A first end of the coil spring 134 is contacted with the bottom base 135, and a second end of the coil spring 134 is contacted with the press piece 133. The top lid 132 is provided with a through-hole 103, and the press piece 133 pass through the through-hole 103 of the top lid 132 to combination with the bottom base 135 by way of clamping. The top lid 132 is provided with a clamping slot, and the light pipe 135 is fixed on the top lid 132 through the clamping slot. The light pipe 135 above the LED light 114 of the circuit board 110, so as to light of the LED light 114 can be evenly distributed and a number or letter on the keyboard 100 can be seen clearly, which can improve user experience. It's worth mentioning that when an end of the conductive pin 1373 of the fixed contact 1372 and an end of the conductive pin 1375 of the movable contact 1374 against on the first abutment 1123 of the connection terminal 112*a*, the deformation of the flat spring 1121 occurs, which makes interference fit between the conductive pin 1373 of the fixed contact 1372 and the first abutment 1123 of corresponding connection terminal 112*a*, and interference fit between the conductive pin 1375 of the movable contact 1374 and the first abutment 1123 of corresponding connection terminal 112*a*.

Figure 5:
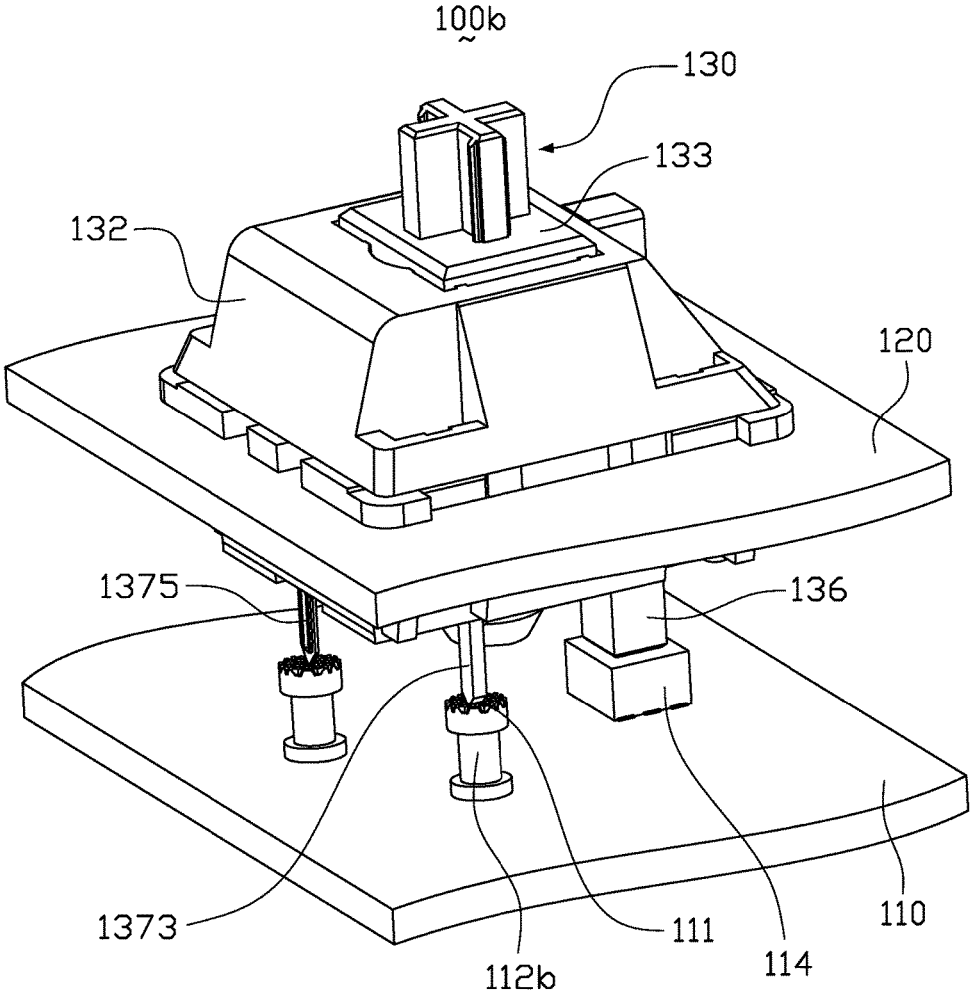
FIG. 5 is a partial structure view of the keyboard of a second embodiment of the present invention.
Figure 6:
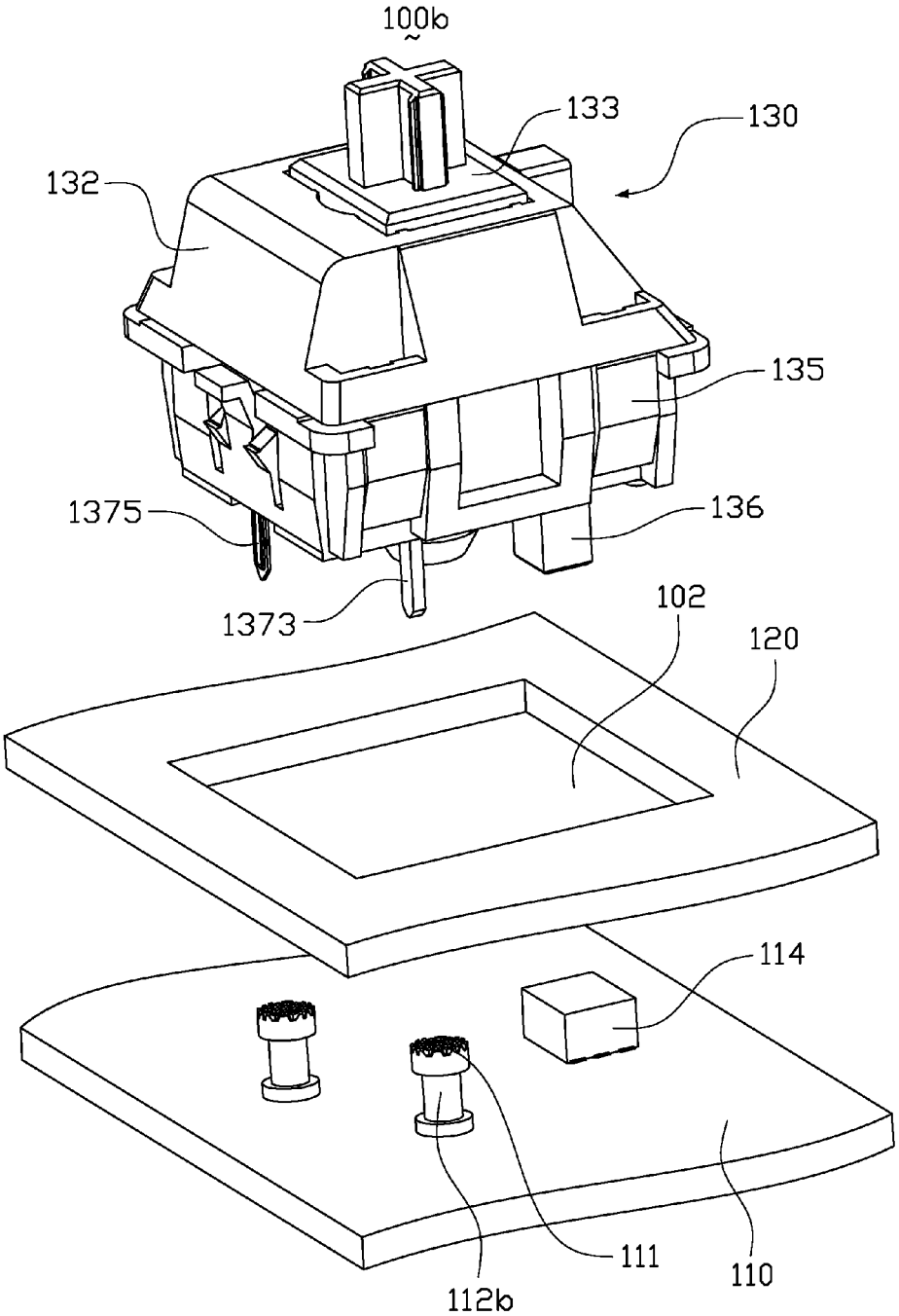
FIG. 6 is an exploded view of partial structure of the keyboard shown in FIG. 5.

FIG. 5 is a partial structure view of the keyboard of a second embodiment of the present invention. FIG. 6 is an exploded view of partial structure of the keyboard shown in FIG. 5. Please referring to FIG. 5 and FIG. 6, construction of the keyboard 100*b* in the embodiment is similar to the keyboard 100*a* of the first embodiment, the difference between the keyboard 100*a* and the keyboard 100*b* is that a connection terminal 112*b* is different from the connection terminal 112*a*.

Specifically, in the embodiment, the connection terminal 112*b* is a columnar structure, a first end of the connection terminal 112*b* is connected to the circuit board 110, a second end of the connection terminal 112*b* is contacted with a conductor 137 of the key switch 130 (the conductive pin 1373 of the fixed contact 1372 of the conductor 137 is contacted with the second end of the connection terminal 112*b*, and the conductive pin 1375 of the movable contact 1374 of the conductor 137 is also contacted with the second end of the connection terminal 112*b*). It's worth mentioning that contact surfaces between the connection terminal 112*b* and the conductor 137 are bump surfaces 111, so as to increase the contact surfaces between the conductor 137 and the connection terminal 112*b* for preventing the conductor 137 sliding on the bump surfaces 111.

Figure 7:
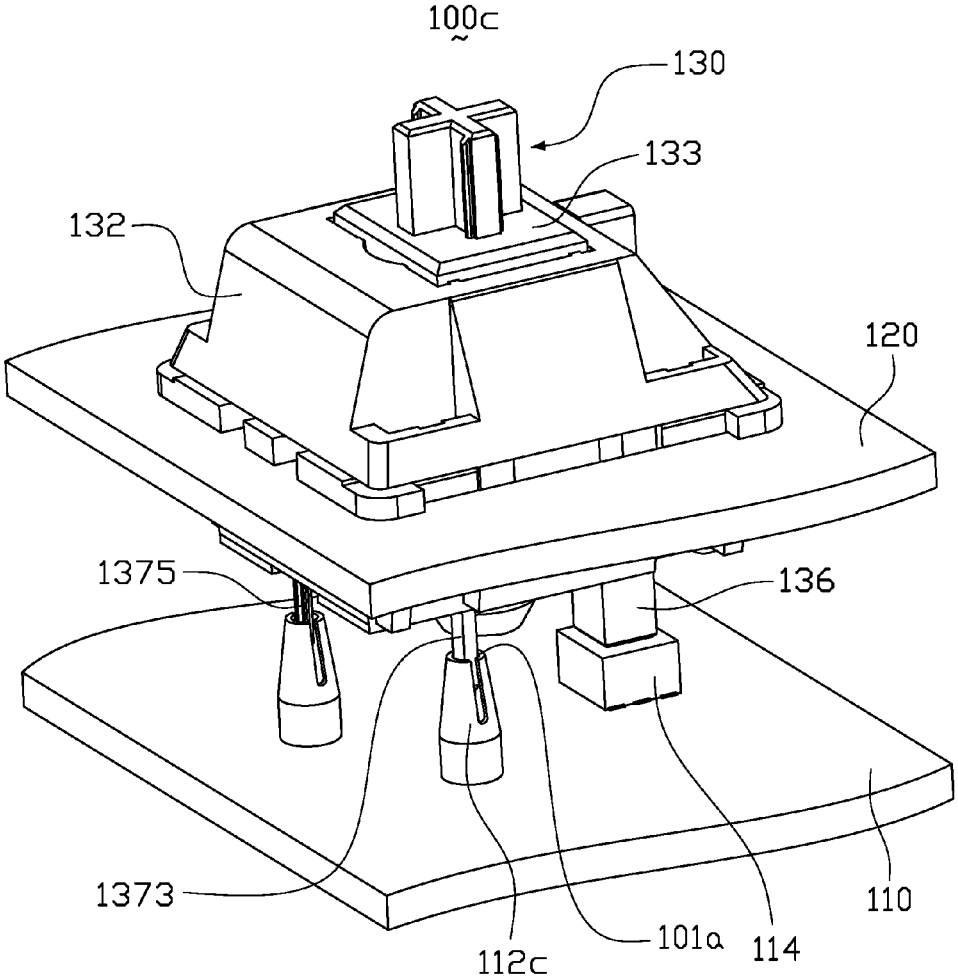
FIG. 7 is a partial structure view of a keyboard of a third embodiment of the present invention.
Figure 8:
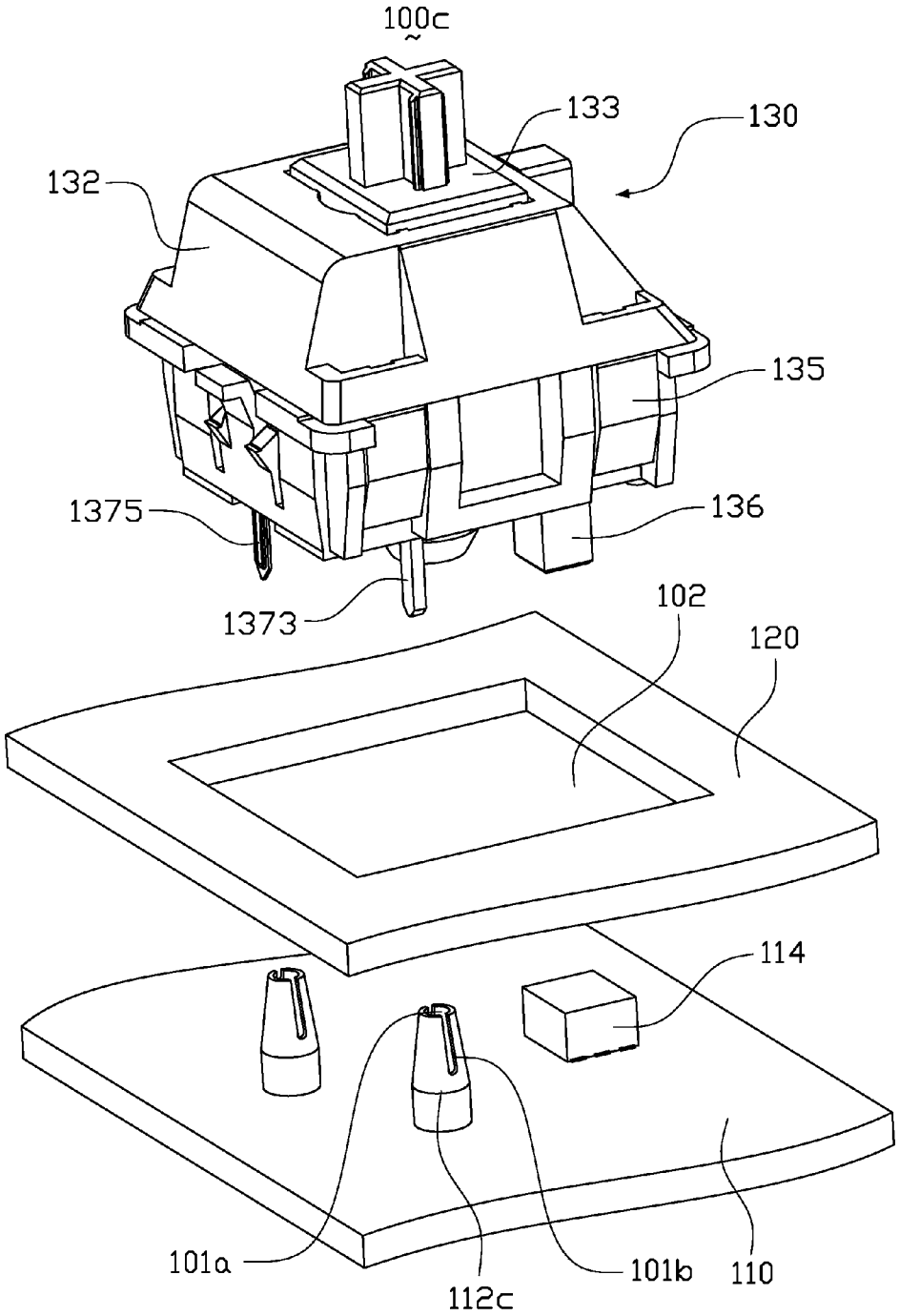
FIG. 8 is an exploded view of partial structure of the keyboard shown in FIG. 7.

FIG. 7 is a partial structure view of a keyboard of a third embodiment of the present invention. FIG. 8 is an exploded view of partial structure of the keyboard shown in FIG. 7. Please referring to FIG. 7 and FIG. 8, construction of the keyboard 100*c* in the embodiment is similar to the keyboard 100*a* of the first embodiment, the difference between the keyboard 100*a* and the keyboard 100*c* is that a connection terminal 112*c* is different from the connection terminal 112*a*.

Specifically, in the embodiment, the connection terminal 112*c* is a columnar structure, a first end of the connection terminal 112*c* is connected to the circuit board 110, a second end of the connection terminal 112*c* is provided with a position limitation hole 101*a*. The conductor 137 is disposed in the position limitation hole 101*a* of the connection terminal 112*c* and is contacted with the connection terminal 112*c* (the conductive pin 1373 of the fixed contact 1372 of the conductor 137 is disposed in the position limitation hole 101*a* and contacted with the connection terminal 112*c*, and the conductive pin 1375 of the movable contact 1374 of the conductor 137 is also disposed in the position limitation hole 101*a* and contacted with the connection terminal 112*c*). It's worth mentioning that the connection terminal 112*c* is provided with a movable slot 101*b* which throughout a wall of the connection terminal 112*c* and connected with the position limitation hole 101*a*. The movable slot 101*b* divides the cylinder shaped wall of the connecting terminal 112*c* into symmetrical two walls, and when the conductive part 137 is disposed in the position limitation hole 101*a*, deformations of the two walls of the connection terminal 112*c* occur, which makes interference fit between the connecting terminal 112*c* and the conductive part 137.

Figure 9:
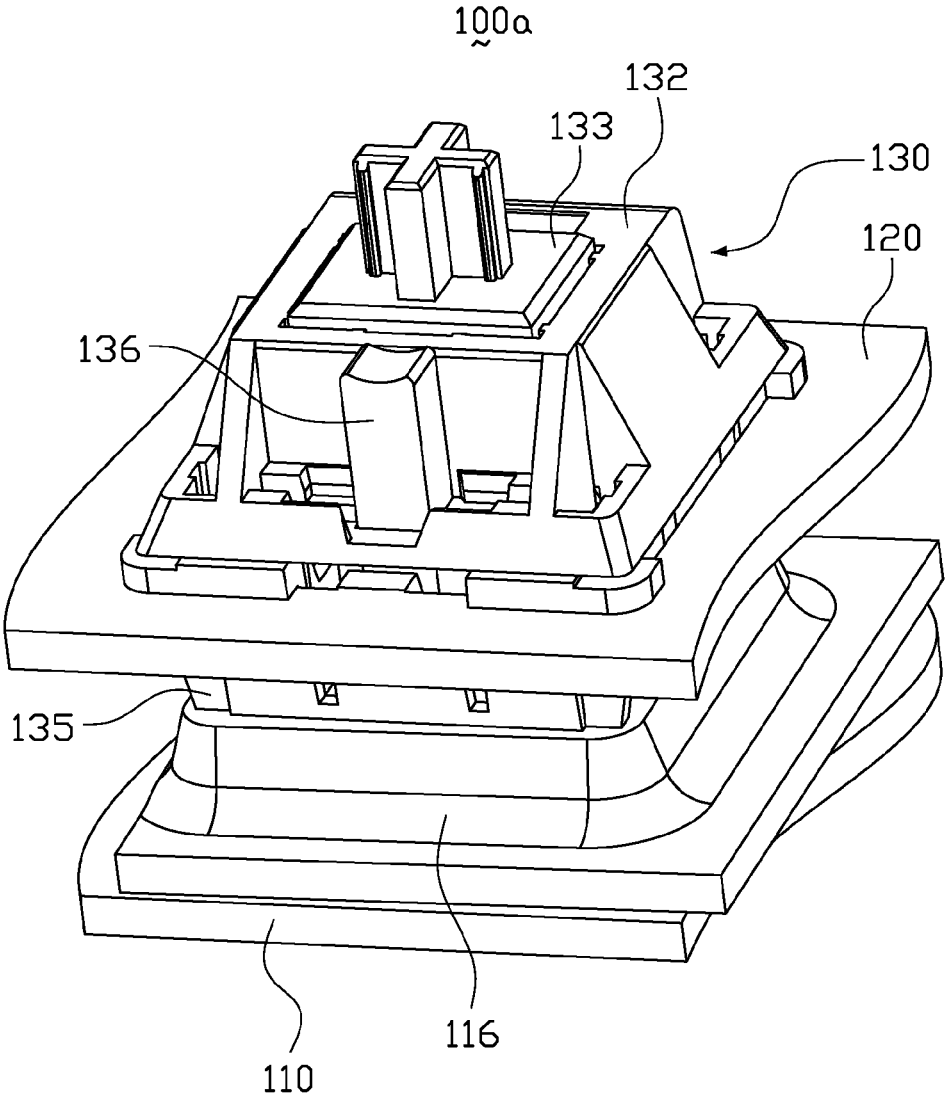
FIG. 9 is a partial structure view of a keyboard of a third embodiment of the present invention.
Figure 10:
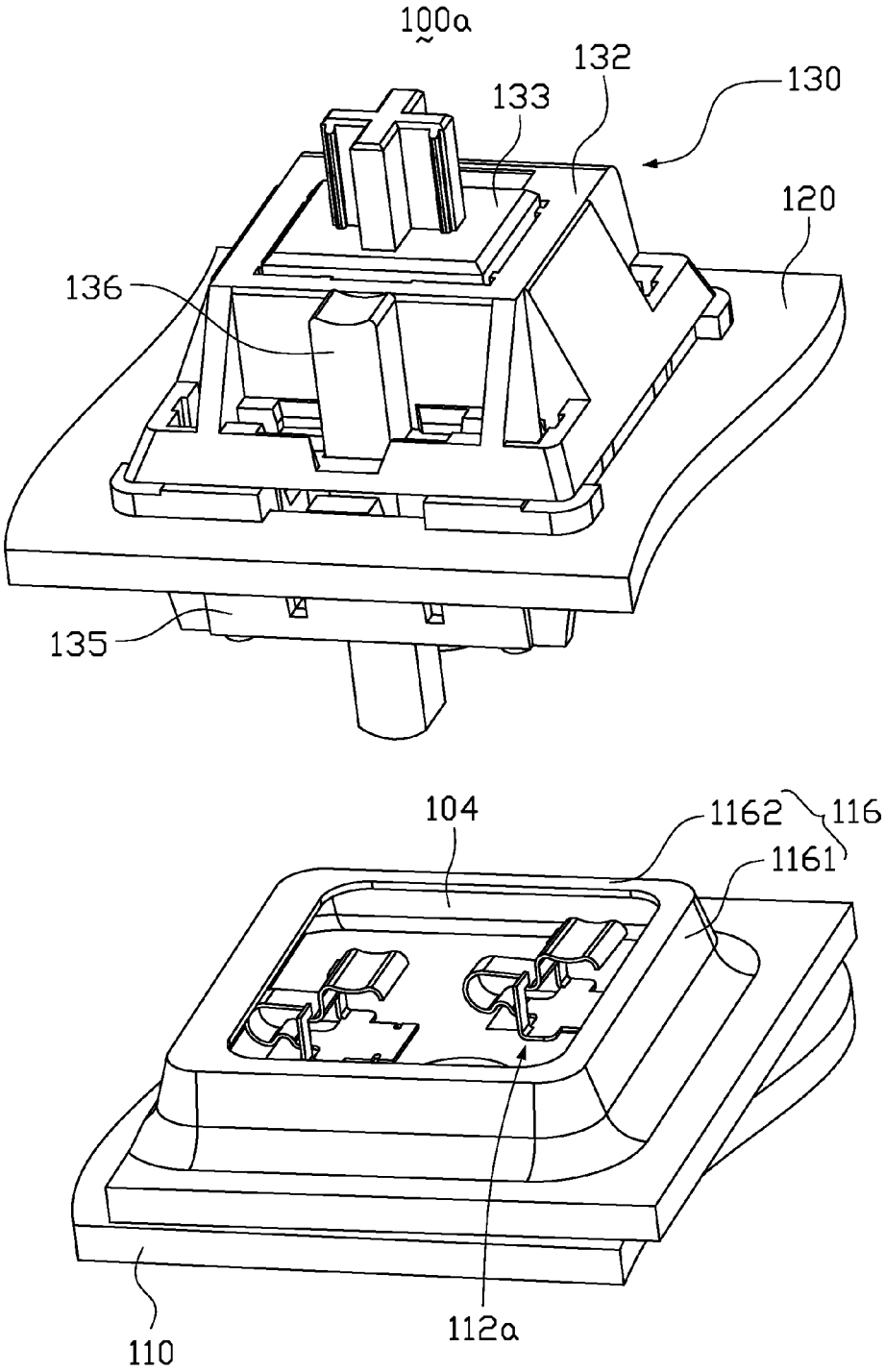
FIG. 10 is an exploded view of partial structure of the keyboard shown in FIG. 9.
Figure 11:
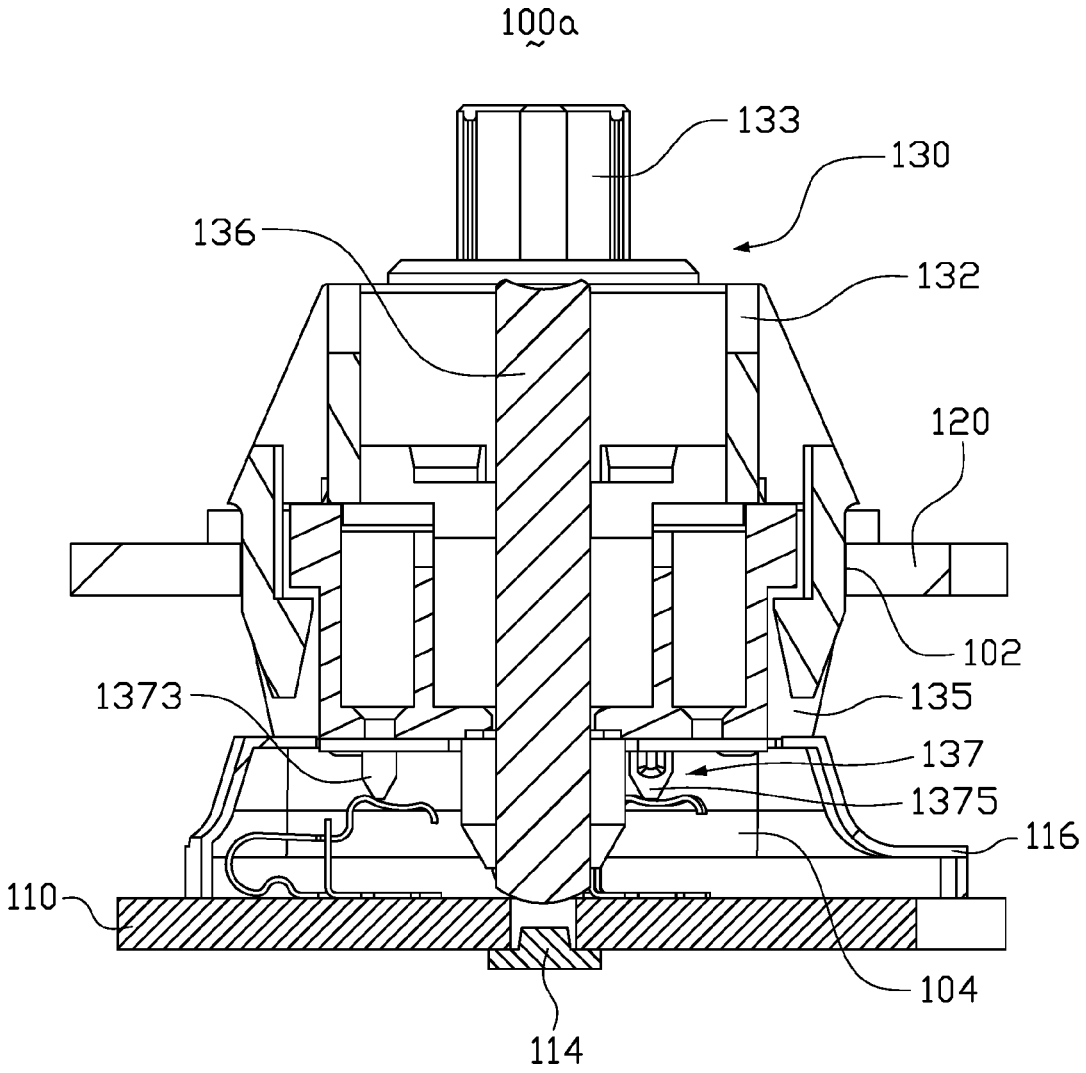
FIG. 11 is a sectional view of the keyboard shown in FIG. 9.

FIG. 9 is a partial structure view of a keyboard of a third embodiment of the present invention. FIG. 10 is an exploded view of partial structure of the keyboard shown in FIG. 9. FIG. 11 is a sectional view of the keyboard shown in FIG. 9. Please refer to FIG. 9, FIG. 10 and FIG. 11, in the embodiment, a first side of the circuit board 110*a* is further provided with a waterproof pouch 116. In the embodiment, the waterproof pouch 116 includes a sidewall 1161 and a top plate 1162. A first end of the sidewall 1161 of the water proof pouch 116 is connected to the circuit board 110, and the second end of the sidewall 1161 of the water proof pouch 116 is connected to the top plates 1162 of the water proof pouch 116. The connection terminal 112*a*, 112*b*, 112*c* is disposed in a holding cavity 104 of the waterproof pouch 116. It's worth mentioning that the waterproof pouch 116, the key switch 130 and the circuit board 110 can meshed with each other to seal the holding cavity 104, so as to preventing the water come into the holding cavity 104.

Figure 12:
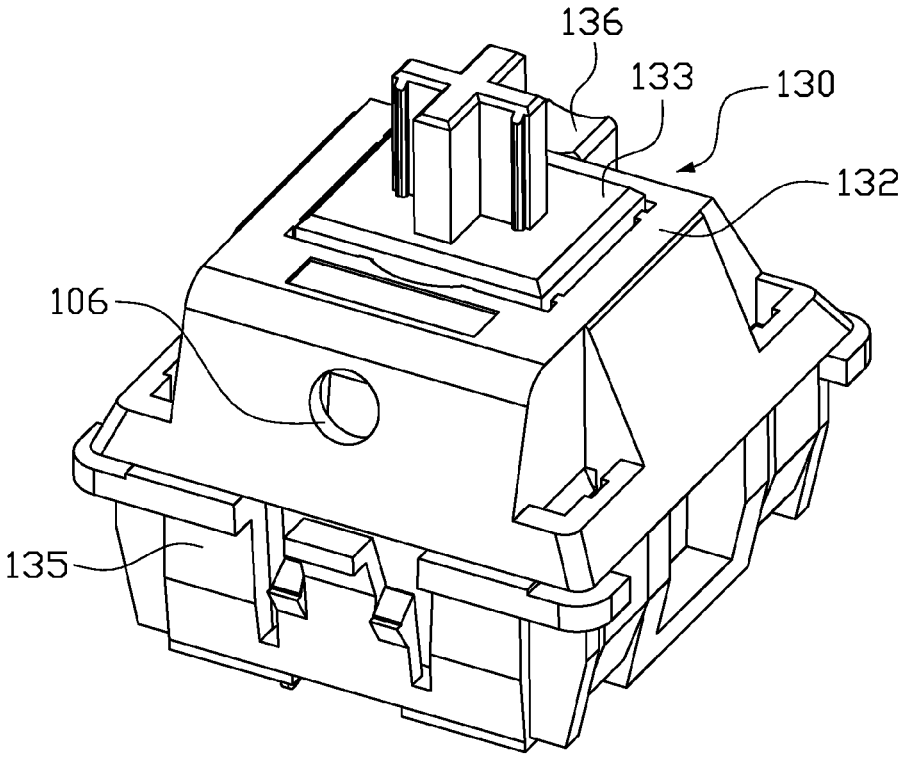
FIG. 12 is a perspective view of the key switch according to a second embodiment of the present invention as viewed from a side view angle.

FIG. 12 is a perspective view of the key switch according to a second embodiment of the present invention as viewed from a side view angle. Please referring to the FIG. 12, in the embodiment, at least one first clearance hole 106 is disposed on the top lid 132 of the key switch 130. The first clearance hole 106 is connected to the key switch's chamber. The first clearance hole 106 can prevents creating a vacuum in the key switch 130 when the press piece 133 moves quickly in the key switch's chamber, so as to keep dust out of the key switch 130.

Figure 13:
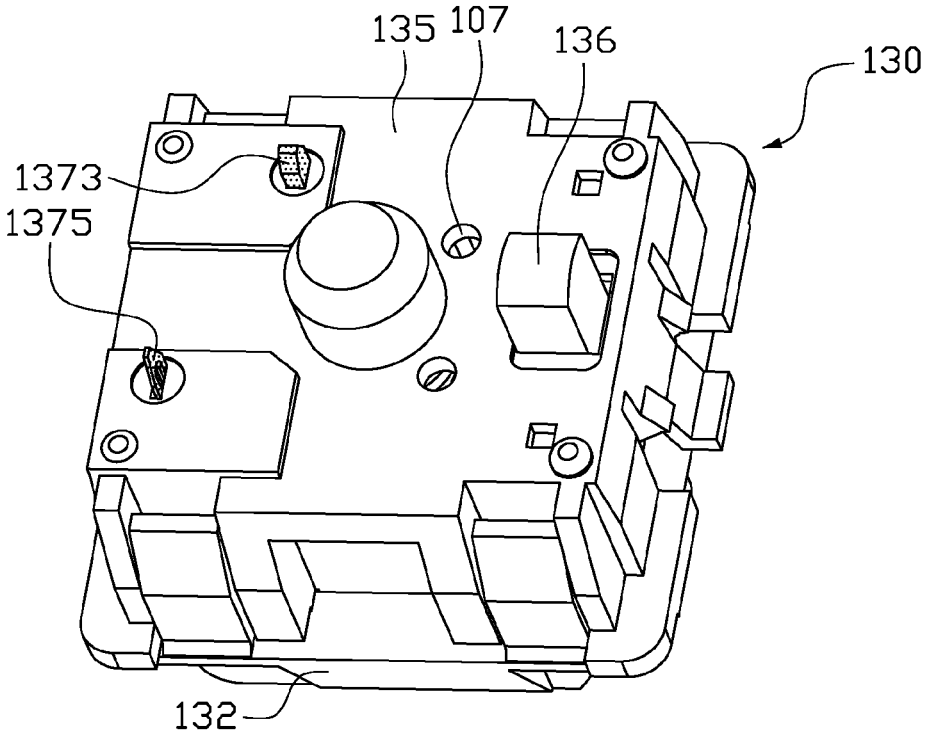
FIG. 13 is a perspective view of the key switch according to a third embodiment of the present invention as viewed from a bottom view angle.

FIG. 13 is a perspective view of the key switch according to a third embodiment of the present invention as viewed from a bottom view angle. Please referring to the FIG. 13, in the embodiment, at least one second clearance hole 107 is disposed on the bottom base 135 of the key switch 130. The second clearance hole 107 is connected to the key switch's chamber and the holding cavity 104 of the water proof pouch 116. The second clearance hole 107 also can prevents creating a vacuum in the key switch 130 when the press piece 133 moves quickly in the key switch's chamber, so as to keep dust out of the key switch 130.

The circuit board 110 and the key installing board 120 of the keyboard 100*a*, 100*b*, 100*c* of the present invention are disposed in housing, and the circuit board 110 is disposed opposite the key installing board 120, the key switches 130 are movably clamped on the key installing board 120 through the installation holes 102 of the key installing board 120. The conductor 137 of each of the key switches 130 extends in the direction of near the circuit board 110, and is contacted with the plurality of connected terminals 112*a*, 112*b*, 112*c* of the circuit board 110, so that when one key switch 130 break down or malfunction, the key switch 130 can be convenient moved and replace it with a new one, which can elongate use-life of the keyboard 100*a*, 100*b*, 100*c*.

While the invention has been described in terms of what is presently considered to be the most practical and preferred embodiments, it is to be understood that the invention needs not be limited to the disclosed embodiment. On the contrary, it is intended to cover various modifications and similar arrangements included within the spirit and scope of the appended claims which are to be accorded with the broadest interpretation so as to encompass all such modifications and similar structures.

What is claimed is:

1. A keyboard, wherein the keyboard comprises a circuit board, a key installing board, and a plurality of key switches, the circuit board is disposed opposite the key installing board, the key installing board is provided with a plurality of installation holes corresponding to the key switches, the plurality of key switches are movably clamped on the key installing board through the plurality of installation holes, each of the key switches comprises a conductor, the conductor extends in the direction of near the circuit board through an installation hole, the circuit board is provided with a plurality of connection terminals working with conductors of the plurality of key switches, the conductors of the plurality of key switches are contacted with the plurality of connected terminals of the circuit board.

2. The keyboard according to claim 1, wherein each of the connected terminals comprises a flat spring, the flat spring comprises a junction and a first abutment disposed opposite the junction, the junction of the flat spring is disposed on the circuit board, the first abutment of the flat spring is contacted with a conductor of a key switch.

3. The keyboard according to claim 2, wherein each of the connected terminals further comprises a first side plate and a second side plate disposed opposite the first side plate, the junction of the flat spring is connected between the first side plate and the second side plate, the flat spring further comprises a second abutment disposed opposite the junction, the second abutment is disposed on one side of the first abutment, and space between the first abutment and the circuit board is greater than space between the second abutment and the circuit board, the first side plate is provided with a first convex block, the second side plate is provided with a second convex block, the first convex block and the second convex block are against on the second abutment.

4. The keyboard according to claim 1, wherein the plurality of connection terminals are columnar structures, and a first end of each of the connection terminals is connected to the circuit board, the second end of each of the connection terminals is contacted with a conductor of a key switch.

5. The keyboard according to claim 4, wherein contact surfaces between the plurality of connection terminals and the plurality of conductors are bump surfaces.

6. The keyboard according to claim 1, wherein the plurality of connection terminals are columnar structures, a first end of each of the connection terminals is connected to the circuit board, a second end of each of the connection terminals is provided with a position limitation hole, the conductors of the plurality of key switches are disposed in position limitation holes of the connection terminals.

7. The keyboard according to claim 1, wherein each of the key switches is provided with a light pipe, the circuit board is provided with a plurality of LED lights working with light pips, the light pip of each of the key switches above a LED light.

8. The keyboard according to claim 1, wherein the keyboard further comprises a pad plate, the pad plate is disposed between the key installing board and the circuit board, the pad plate is provided with a plurality of hollow holes working with the plurality of the installation holes, the circuit board is exposed from the plurality of hollow holes.

9. The keyboard according to claim 8, wherein the pad plate is made of plastic.

10. The keyboard according to claim 1, wherein the key installing board is connected to the circuit board through a plurality of bolts, and the plurality of bots support the key installing board.

11. The keyboard according to claim 1, wherein the conductors of the plurality of key switches are plated with gold.

12. The keyboard according to claim 1, wherein the circuit board is further provided with a waterproof pouch, the plurality of connection terminals are disposed in a holding cavity of the waterproof pouch.

13. The keyboard according to claim 12, wherein the waterproof pouch comprises a sidewall and a top plate, a first end of the sidewall is connected to the circuit board, the second end of the sidewall is connected to the top plates of the water proof pouch.

14. The keyboard according to claim 1, wherein the key switch comprises a top lid, at least one first clearance hole is disposed on the top lid of the key switch, the first clearance hole is connected to the key switch's chamber.

15. The keyboard according to claim 1, wherein the key switch comprises a bottom base, at least one second clearance hole is disposed on the bottom base of the key switch, the second clearance hole is connected to the key switch's chamber.

* * * * *